US009864299B2

(12) United States Patent
Iikura et al.

(10) Patent No.: US 9,864,299 B2
(45) Date of Patent: Jan. 9, 2018

(54) IMAGE FORMING APPARATUS INCLUDING A DEVELOPING UNIT TO DEVELOP AN ELECTROSTATIC LATENT IMAGE ON A PHOTOSENSITIVE MEMBER

(71) Applicant: CANON KABUSHIKI KAISHA, Tokyo (JP)

(72) Inventors: Takayuki Iikura, Kashiwa (JP); Kazunori Miyake, Abiko (JP); Shinya Suzuki, Toride (JP); Toshifumi Kakutani, Abiko (JP); Yousuke Hata, Ichikawa (JP); Kazumi Sato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/047,414

(22) Filed: Feb. 18, 2016

(65) Prior Publication Data

US 2016/0161892 A1 Jun. 9, 2016

Related U.S. Application Data

(63) Continuation of application No. 14/445,899, filed on Jul. 29, 2014, now Pat. No. 9,291,990.

(30) Foreign Application Priority Data

Jul. 31, 2013 (JP) ..... 2013-159298

(51) Int. Cl.
*G03G 15/08* (2006.01)
*G03G 21/16* (2006.01)
(Continued)

(52) U.S. Cl.
CPC ..... *G03G 15/0822* (2013.01); *G03G 15/0868* (2013.01); *G03G 15/0872* (2013.01);
(Continued)

(58) Field of Classification Search
CPC ..... G03G 15/0822; G03G 15/0837; G03G 15/0836; G03G 15/087; G03G 15/0872;
(Continued)

(56) References Cited

U.S. PATENT DOCUMENTS 9,291,990 B2 * 3/2016 Iikura ..... G03G 21/1676
2003/0219262 A1 * 11/2003 Doi ..... G03G 15/0872 399/12

(Continued)

*Primary Examiner* — David M Gray
*Assistant Examiner* — Andrew V Do
(74) *Attorney, Agent, or Firm* — Canon U.S.A., Inc. IP Division

(57) ABSTRACT

An image forming apparatus includes a developing unit configured to develop an electrostatic latent image, a mounting detection unit configured to detect that a container T is mounted on a mounting unit, a driving unit configured to rotate the container T, a rotation detection unit configured to detect rotation information about the container T, and a controller configured to control the driving unit based on the rotation information. If the container T is detected to be mounted on the mounting unit, control of the driving unit is not carried out based on the rotation information until replenishment information satisfies a predetermined condition.

9 Claims, 9 Drawing Sheets

(51) Int. Cl.
*G03G 15/00* (2006.01)
*G03G 21/18* (2006.01)

(52) U.S. Cl.
CPC ..... *G03G 15/553* (2013.01); *G03G 21/1676* (2013.01); *G03G 15/0837* (2013.01); *G03G 21/1875* (2013.01); *G03G 21/1896* (2013.01)

(58) Field of Classification Search
CPC ... G03G 2215/0663; G03G 2215/0665; G03G 2215/0668; G03G 2215/067; G03G 15/553
USPC ..... 399/13
See application file for complete search history.

(56) References Cited

U.S. PATENT DOCUMENTS

2012/0014713 A1* 1/2012 Murakami ..... G03G 15/0865 399/119
2013/0202275 A1* 8/2013 Brown ..... H02P 7/29 388/809

* cited by examiner

IMAGE FORMING APPARATUS INCLUDING A DEVELOPING UNIT TO DEVELOP AN ELECTROSTATIC LATENT IMAGE ON A PHOTOSENSITIVE MEMBER

CROSS-REFERENCE TO RELATED APPLICATIONS

This application is a Continuation of U.S. application Ser. No. 14/445,899 filed Jul. 29, 2014 which claims priority from Japanese Patent Application No. 2013-159298 filed Jul. 31, 2013, all of which are hereby incorporated by reference herein in their entirety.

BACKGROUND OF THE INVENTION

Field of the Invention

The present invention relates to an image forming apparatus on which a container containing toner is mounted.

Description of the Related Art

An electrophotographic image forming apparatus forms a toner image by developing an electrostatic latent image formed on a photosensitive member with a developer (hereinafter, referred to as toner) in a developing unit. The developing unit can store only a limited amount of toner inside. The developing unit thus needs to be replenished, when needed, with toner from a container detachably mounted on the main body of the image forming apparatus.

US Patent 2014/0016967 discusses a container that includes a rotation unit to be driven to rotate, a pump unit configured to change an internal pressure of a containing unit containing toner to discharge the toner from the containing unit, and a conversion unit configured to convert rotational motion of the rotation unit into expansion and contraction of the pump unit. The container discharges the toner in the containing unit by making the pump unit expand and contract according to the rotation of the container. More specifically, when the pump unit expands, air sucked in from a discharge port loosens the toner in the containing unit. The pump unit is then compressed to pressurize the containing unit, whereby the air in the container pushes the toner covering the discharge port out of the discharge port.

To accurately control the amount of toner discharged from such a container, the rotation speed of the container needs to be accurately controlled. The rotation speed may be controlled, for example, by measuring the time during which a predetermined portion formed on the container in the direction of rotation is detected while the container is rotated, and controlling the rotation speed of the container based on the measured time. However, with such a configuration, the rotation speed of the container can vary even while the predetermined portion of the container is being detected, depending on the rotation angle of the container when the container is mounted on a mounting unit. As a result, it is not possible to accurately measure the time during which the predetermined portion of the container is detected, or precisely control the rotation speed of the container.

SUMMARY OF THE INVENTION

In an exemplary embodiment, an image forming apparatus includes a developing unit configured to develop an electrostatic latent image formed on an photosensitive member with toner, a mounting unit configured to mount a container containing toner, a mounting detection unit configured to detect that the container is mounted on the mounting unit, a driving unit configured to rotate the container mounted on the mounting unit to replenish the developing unit with the toner from the container, a rotation detection unit configured to detect rotation information about the container rotated by the driving unit, and a controller configured to control the driving unit such that a rotation speed of the container coincides with a predetermined speed, based on the rotation information detected by the rotation detection unit. The controller is configured to, if the mounting detection unit detects that the container is mounted on the mounting unit, not control the driving unit based on the rotation information until the number of rotations, rotation time, or information about the number of executions of a replenishment operation of the container mounted on the mounting unit satisfies a predetermined condition.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

(Description of Image Forming Apparatus)

Figure 1:
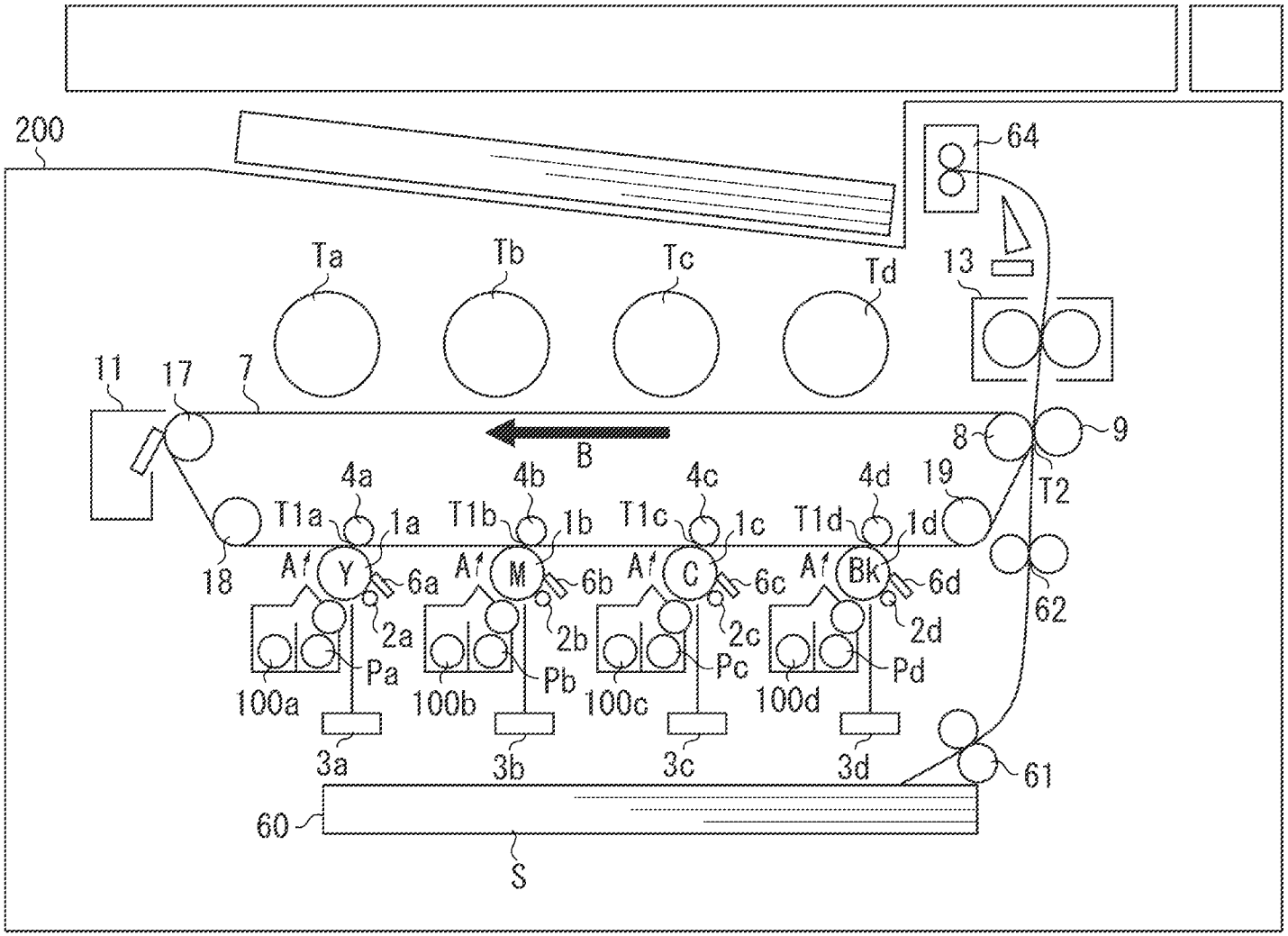
FIG. 1 is a schematic sectional view of an image forming apparatus.

FIG. 1 is a schematic sectional view of an image forming apparatus 200. The image forming apparatus 200 includes four image forming units Pa, Pb, Pc, and Pd for forming toner images of respective color components. The image forming units Pa, Pb, Pc, and Pd are arranged in a row in a conveyance direction of an intermediate transfer belt 7. The image forming unit Pa forms a yellow toner image. The image forming unit Pb forms a magenta toner image. The image forming unit Pc forms a cyan toner image. The image forming unit Pd forms a black toner image.

Toner bottles Ta, Tb, Tc, and Td detachably attachable to the image forming apparatus 200 are mounted on the image forming apparatus 200. The toner bottle Ta contains yellow toner. The toner bottle Tb contains magenta toner. The toner bottle Tc contains cyan toner. The toner bottle Td contains black toner. The toner bottles Ta, Tb, Tc, and Td correspond to containers containing toner.

The image forming units Pa, Pb, Pc, and Pd have similar configurations. In the following description, the image forming units Pa, Pb, Pc, and Pd will therefore be referred to as image forming units P. The toner bottles Ta, Tb, Tc, and Td will be referred to as toner bottles T.

The image forming units P each include a photosensitive drum 1, a charging unit 2, and a developing unit 100. The photosensitive drum 1 includes a photosensitive layer functioning as a photosensitive member on a surface of a cylindrical metal roller. The charging unit 2 charges the photosensitive drum 1. The developing unit 100 stores toner. The photosensitive drum 1 rotates in the direction of the arrow A. After the charging unit 2 charges the photosensitive drum 1, a laser exposure device 3 exposes the photosensitive drum 1 to a laser based on image data. An electrostatic latent image is thereby formed on the photosensitive drum 1. The developing unit 100 develops the electrostatic latent image on the photosensitive drum 1 with the toner. A toner image is thereby formed on the photosensitive drum 1. The developing unit 100 includes a permeability sensor 610 (FIG. 2) which detects the amount of toner stored in the developing unit 100. If the permeability sensor 610 detects that the amount of toner in the developing unit 100 has decreased, toner is supplied from the toner bottle T to the developing unit 100.

The intermediate transfer belt 7 is wound around a secondary transfer counter roller 8, a driven roller 17, a first tension roller 18, and a second tension roller 19. The intermediate transfer belt 7 is driven by the secondary transfer counter roller 8 to rotate in the direction of the arrow B.

The image forming units P each include a primary transfer roller 4 which transfers the toner image on the photosensitive drum 1 to the intermediate transfer belt 7. While the toner image formed on the photosensitive drum 1 passes through a primary transfer nip portion T1 where the primary transfer roller 4 is pressed against the photosensitive drum 1 and the intermediate transfer belt 7, a primary transfer voltage is applied to the primary transfer roller 4. The toner image on the photosensitive drum 1 is thereby transferred to the intermediate transfer belt 7. The toner images formed on the photosensitive drums 1*a*, 1*b*, 1*c*, and 1*d* are transferred to the intermediate transfer belt 7 in a superposed manner, whereby a full color toner image is borne on the intermediate transfer belt 7. The toner remaining on the photosensitive drums 1 is removed by respective drum cleaners 6.

A sheet feeding roller (not illustrated) feeds a recording material S stored in a cassette unit 60, and a conveyance roller pair 61 conveys the recording material S to a registration roller pair 62. The registration roller pair 62 adjusts timing of conveyance of the recording material S to a secondary transfer nip portion T2 so that the toner image on the intermediate transfer belt 7 is transferred to a desired position on the recording material S.

A secondary transfer roller 9 is arranged on the opposite side of the secondary transfer counter roller 8 with respect to the intermediate transfer belt 7. When a secondary transfer voltage is applied to the secondary transfer counter roller 8, the toner image on the intermediate transfer belt 7 is transferred to the recording material S in a secondary transfer nip portion T2 where the secondary transfer roller 9 is pressed against the secondary transfer counter roller 8 and the intermediate transfer belt 7. The toner remaining on the intermediate transfer belt 7 without transferring to the the recording materials S in the secondary transfer nip portion T2 is removed by a belt cleaner 11.

After the toner image is transferred to the recording material S by the secondary transfer roller 9, the recording material S is conveyed to a fixing device 13. The fixing device 13 includes a fixing roller and a pressure roller. The fixing roller includes a heater. The fixing device 13 fixes the toner image on the recording material S with the heat from the heater and a pressure between the fixing roller and the pressure roller. The recording material S on which the toner image has been fixed by the fixing device 13 is discharged from the image forming apparatus 200 by a sheet discharge roller pair 64.

(Configuration of Control Unit)

Figure 2:
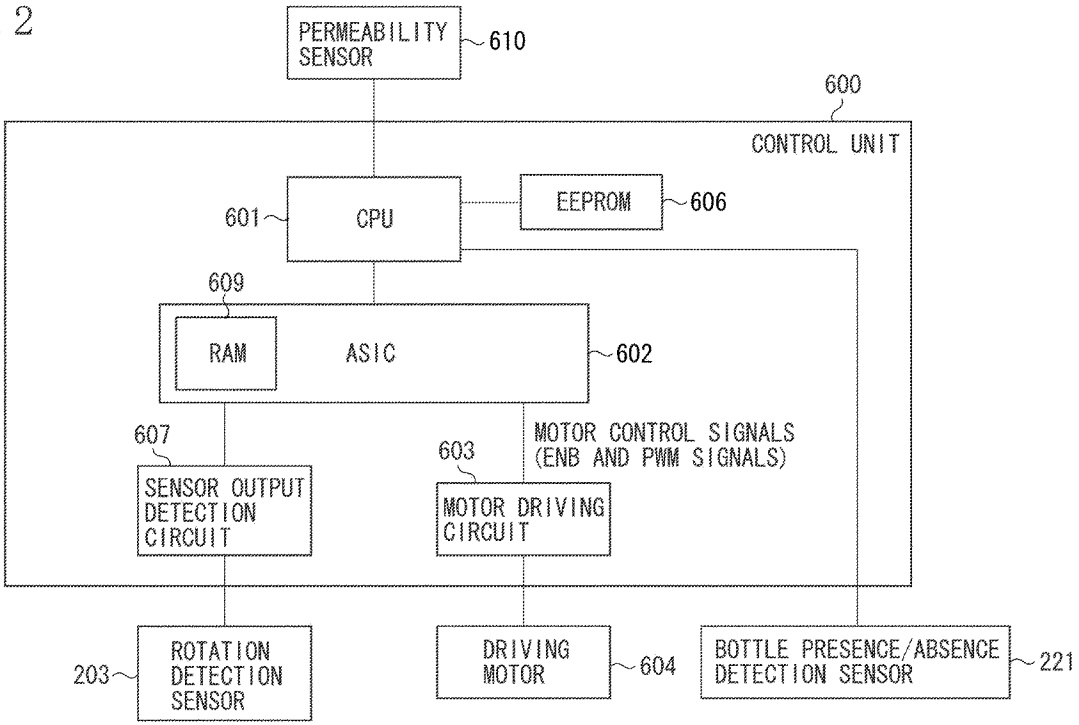
FIG. 2 is a control block diagram of the image forming apparatus.

FIG. 2 is a control block diagram of the image forming apparatus 200 according to the present exemplary embodiment. A control unit 600 includes a central processing unit (CPU) 601, an application specific integrated circuit (ASIC) 602, a motor driving circuit 603, an electrically erasable programmable read-only memory (EEPROM) 606, and a sensor output detection circuit 607.

The CPU 601 is a control circuit that controls the devices of the image forming apparatus 200. The ASIC 602 is a dedicated integrated circuit (IC) that controls toner replenishment operations for supplying toner from the toner bottles T to the developing units 100. The motor driving circuit 603 controls a current to be supplied to a driving motor 604 to control the driving motor 604. The EEPROM 606 is a nonvolatile memory that stores information about the toner bottle T that is mounted on a mounting unit 310. The sensor output detection circuit 607 outputs a signal that varies according to a result of detection of a protruded portion 220 (predetermined portion) of the toner bottle T performed by a rotation detection sensor 203.

A bottle detection sensor 221 is an optical sensor which is arranged on the mounting unit 310 of the image forming apparatus 200 and includes a light emitting unit and a light receiving unit. The bottle detection sensor 221 is configured such that if the toner bottle T is mounted on the mounting unit 310, a projection 222*a* of a cap unit 222 of the toner bottle T blocks light that is emitted from the light emitting unit to the light receiving unit of the optical sensor. If the light emitted from the light emitting unit is received by the light receiving unit, the CPU 601 determines that the toner bottle T is not mounted on the mounting unit 310. If the light emitted from the light emitting unit is not received by the light receiving unit, the CPU 601 determines that the toner bottle T is mounted on the mounting unit 310. In other words, the CPU 601 and the bottle detection sensor 221 function as a mounting detection unit for detecting that the toner bottle T is mounted on the mounting unit 310.

The permeability sensor 610 outputs to the CPU 601 a signal that varies according to the amount of toner in the developing unit 100. The CPU 601 detects the amount of toner in the developing unit 100 based on the output value of the permeability sensor 610. If the amount of toner in the developing unit 100 falls to or below a predetermined amount, the CPU 601 controls the ASIC 602 to perform a replenishment operation for replenishing the developing unit 100 with the toner from the toner bottle T.

The driving motor 604 is a driving source for rotating the toner bottle T to replenish the developing unit 100 with the toner from the toner bottle T. The ASIC 602 sets a pulse width modulation (PWM) signal based on a ratio (control value) of time for supplying a current to the driving motor 604 per minute time. The motor driving circuit 603 controls the current to be supplied to the driving motor 604 based on the PWM signal set by the ASIC 602.

In the present exemplary embodiment, a direct-current (DC) motor (DC brush motor) is used as the driving motor 604. The rotation speed and the rotation driving force of the driving motor 604 change according to the ratio of the time during which the current is supplied to the driving motor 604 in a minute time.

The motor driving circuit 603 supplies the current to the driving motor 604 according to the PWM signal while the ASIC 602 is outputting an ENB signal. As a result, the toner bottle T is driven to rotate. When the ASIC 602 stops the ENB signal, the motor driving circuit 603 stops supplying the current to the driving motor 604. As a result, the toner bottle T is stopped.

The rotation detection sensor 203 is an optical sensor including a light emitting unit and a light receiving unit. The rotation detection sensor 203 outputs a signal according to the amount of light received by the light receiving unit. When a protruded portion 220 (predetermined portion) of the toner bottle T is passing a detection position, the amount of light received by the rotation detection sensor 203 falls below a threshold. When areas of the toner bottle T other than the predetermined portion in the rotation direction in which the toner bottle T rotates are passing the detection position, the amount of light received by the rotation detection sensor 203 becomes greater than or equal to the threshold value. A specific configuration of the rotation detection sensor 203 will be described below with reference to FIGS. 5 and 6.

Based on the output signal of the rotation detection sensor 203, the sensor output detection circuit 607 outputs a high-level signal if the amount of light received by the rotation detection sensor 203 is greater than or equal to the threshold. The sensor output detection circuit 607 outputs a low-level signal if the amount of light received by the rotation detection sensor 203 is smaller than the threshold. In other words, the sensor output detection circuit 607 outputs the low-level signal while the predetermined portion of the toner bottle T passes the detection position. The sensor output detection unit 607 outputs the high-level signal while the areas of the toner bottle T other than the predetermined portion pass the detection position.

The ASIC 602 measures the time during which the predetermined portion of the toner bottle T is detected by the rotation detection sensor 203. In other words, the ASIC 602 measures the time when the sensor detection circuit 607 is outputting the low-level signal. The time measured by the ASIC 602 is stored in a random access memory (RAM) 609 of the ASIC 602.

(Description of Mounting Unit)

Figure 3A:
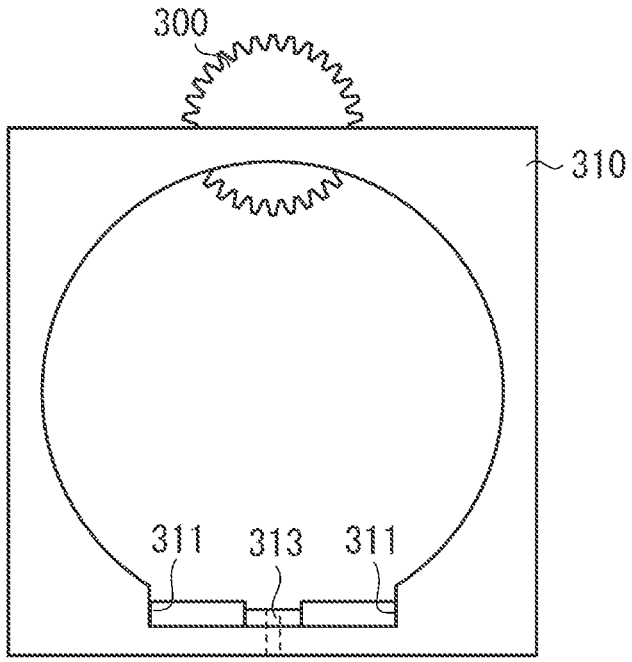
FIGS. 3A and 3B are schematic diagrams illustrating essential parts of a mounting unit of a toner bottle.
Figure 3B:
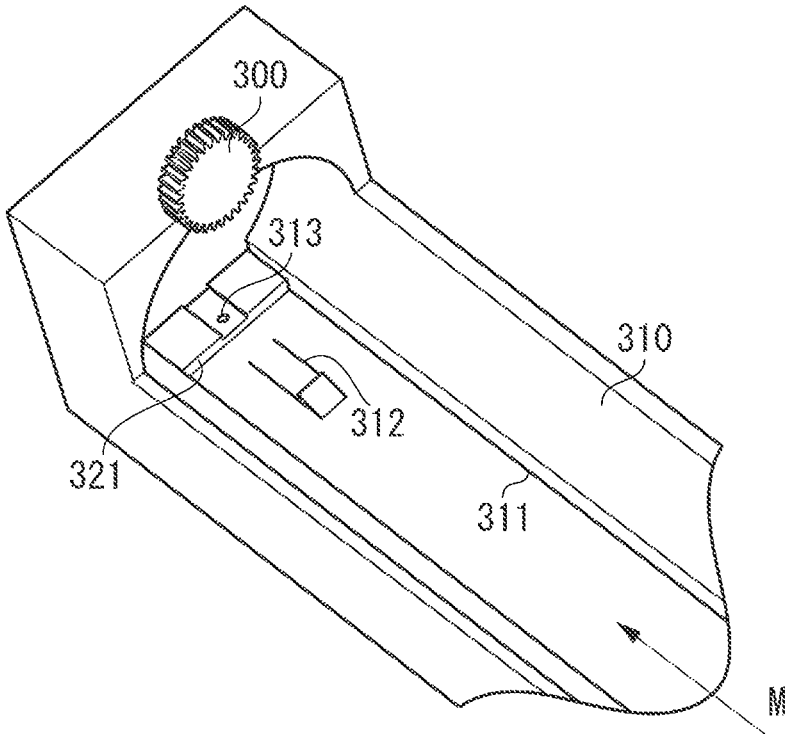

The toner bottle T is mounted on the mounting unit 310 arranged on the image forming apparatus 200. A configuration of the mounting unit 310 will be described with reference to FIGS. 3A and 3B. FIG. 3A is a partial front view of the mounting unit 310 seen from the front in a mounting direction of the toner bottle T. FIG. 3B is a perspective view for describing the interior of the mounting unit 310. As illustrated in FIG. 3B, the toner bottle T is mounted on the mounting unit 310 in the direction of the arrow M. The direction of the arrow M is parallel to the direction of the rotation axis of the photosensitive drum 1 in the image forming apparatus 200. The toner bottle T is dismounted from the mounting unit 310 in the direction opposite to the direction of the arrow M.

The mounting unit 310 includes a drive gear 300, rotation direction restriction portions 311, a bottom portion 321, and a rotation axis direction restriction portion 312. The drive gear 300 is coupled to a rotation shaft of the driving motor 604. The rotation direction restriction portions 311 restrict rotation of the cap unit 222 (FIG. 4A to FIG. 4C) of the toner bottle T along with the toner bottle T. The rotation axis direction restriction portion 312 latches the cap unit 222 (FIG. 4A to FIG. 4C) of the toner bottle T and thereby restricts movement of the cap unit 222 (FIG. 4A to FIG. 4C) in the direction of the rotation axis.

The bottom portion 321 has a reception port (reception hole) 313. If the toner bottle T is mounted, the reception port 313 communicates with a discharge port (discharge hole) 211 (FIGS. 4B and 4C) of the toner bottle T and receives toner discharged from the toner bottle T. The toner discharged from the discharge port 211 (FIGS. 4B and 4C) of the toner bottle T is supplied to the developing unit 100 through the reception port 313. In the present exemplary embodiment, the reception port 313 has the same diameter as that of the discharge port 211. For example, the diameter is approximately 2 mm.

Figure 4A:
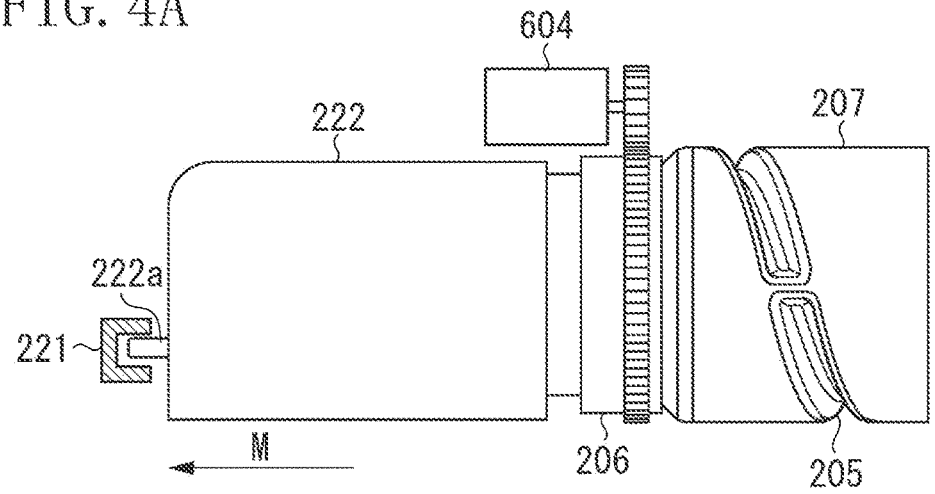
FIGS. 4A, 4B, and 4C are schematic diagrams illustrating essential parts of the toner bottle.
Figure 4B:
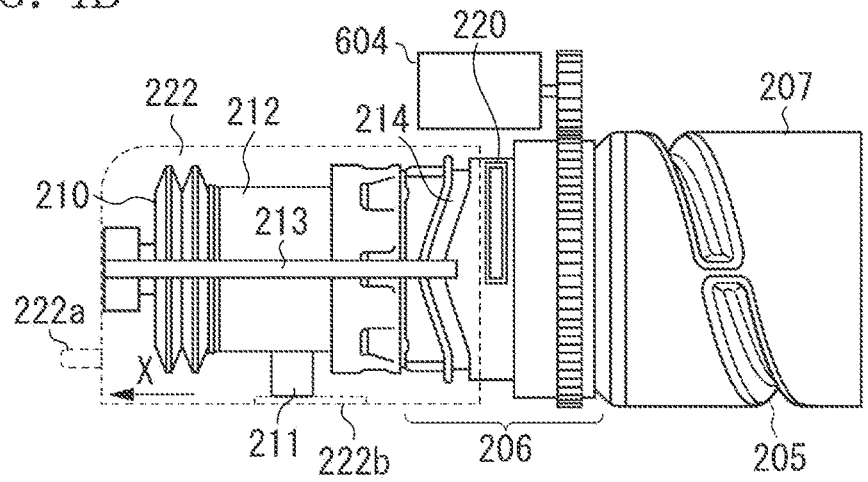
Figure 4C:
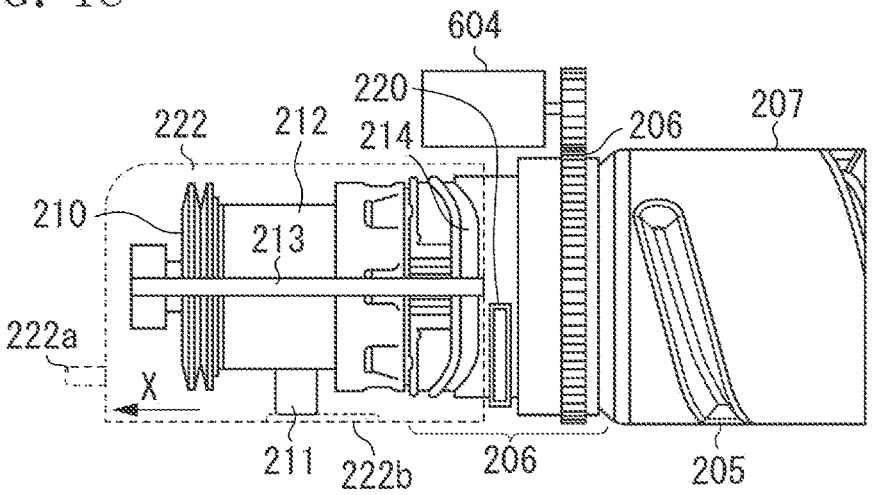

The drive gear 300 is fixed to the rotation shaft of the driving motor 604 (FIG. 4A to FIG. 4C). The drive gear 300 transmits the rotation driving force from the driving motor 604 to the toner bottle T mounted on the mounting unit 310.

(Description of Toner Bottle)

FIG. 4A is an appearance view of the toner bottle T mounted on the mounting unit 310. FIGS. 4B and 4C are schematic diagrams illustrating a structure inside the cap unit 222 of the toner bottle T mounted on the mounting unit 310.

The toner bottle T includes a containing unit 207, a drive transmission unit 206, a discharge unit 212, and a pump unit 210. The containing unit 207 contains toner. The rotation driving force from the driving motor 604 is transmitted to the drive transmission unit 206. The discharge unit 212 has the discharge port 211 for discharging the toner. The pump unit 210 is configured to discharge the toner in the discharge unit 212 through the discharge port 211. The toner bottle T further includes a reciprocation member 213 which makes the pump unit 210 expand and contract. The drive transmission unit 206 includes protruded portions 220 (predetermined portions) and a cam groove 214. The cam groove 214 is formed around the periphery of the drive transmission unit 206 in the rotation direction in which the drive transmission unit 206 of the toner bottle T rotates.

The cam groove 214 formed in the drive transmission unit 206 and the protruded portions 220 rotate integrally with the drive transmission unit 206. When the rotation driving force of the driving motor 604 is transmitted to the drive transmission unit 206 of the toner bottle T via the drive gear 300, the drive transmission unit 206 of the toner bottle T and the containing unit 207 coupled to the drive transmission unit 206 rotate. Spiral protruded portions 205 are formed inside the containing unit 207. As the containing unit 207 rotates, the protruded portions 205 convey the toner in the containing unit 207 toward the discharge port 211.

The rotation of the cap unit 222 is restricted by the mounting unit 310. The cap unit 222 therefore will not rotate even when the drive transmission unit 206 rotates. The rotation of the toner discharge port 211, the pump unit 210, and the reciprocation member 213 is also restricted along with the cap unit 222. Accordingly, the toner discharge port 211, the pump unit 210, and the reciprocation member 213 will not rotate even when the drive transmission unit 206 rotates.

Figure 5:
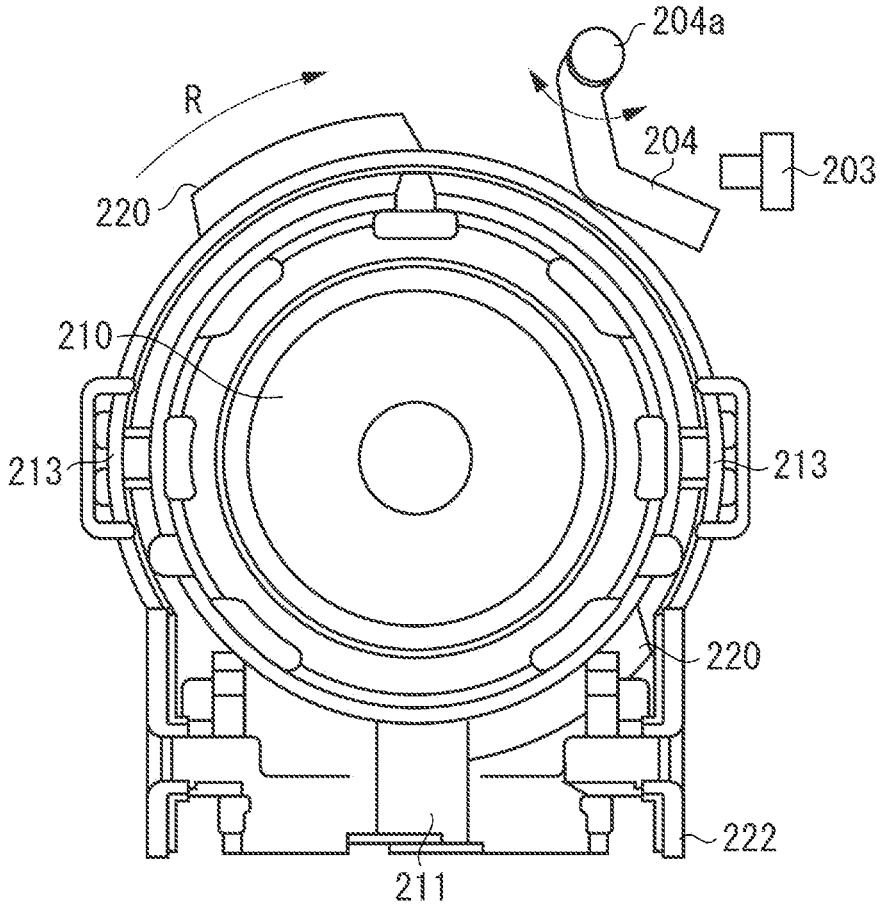
FIG. 5 is a schematic diagram illustrating essential parts of a rotation detection sensor.

Rotation restriction grooves are formed inside the cap unit 222. The rotation restriction groove are configured to restrict rotation of the reciprocation member 213 caused by rotation of the drive transmission unit 206. The reciprocation member 213 is engaged with the rotation restriction grooves (FIG. 5). The reciprocation member 213 is further connected to the pump unit 210, and includes not-illustrated tab portions which are engaged with the cam groove 214 of the drive transmission unit 206. When the drive rotation member 206 rotates, the reciprocation member 213 moves along the cam groove 214 while the rotation of the reciprocation member 213 is restricted. As a result, the reciprocation member 213 reciprocates in the direction of the arrow X (the longitudinal direction of the toner bottle T).

The reciprocation member 213 is coupled to the pump unit 210. The reciprocation of the reciprocation member 213 makes the pump unit 210 repeat expansion and compression alternately. The reciprocation member 213 moves in the direction of the arrow X to expand the pump unit 210. The expansion of the pump unit 210 decreases the internal pressure of the toner bottle T, whereby air is sucked in from the discharge port 211 to loosen the toner in the discharge unit 212. The reciprocation member 213 then moves in the direction opposite to the direction of the arrow X to compress the pump unit 210. The compression of the pump unit 210 increases the internal pressure of the toner bottle T, whereby toner deposited in the discharge port 211 is supplied from the discharge port 211 to the developing unit 100 through a toner conveyance path (not illustrated).

The cap unit 222 has the projection 222*a* on the top side of the toner bottle T in the mounting direction (the direction of the arrow M). When the toner bottle T is mounted in the mounting position, the bottle detection sensor 221 detects the projection 222*a* of the cap unit 222. The bottle detection sensor 221 then outputs to the CPU 601 a signal indicating that the toner bottle T is mounted.

The cap unit 222 further includes a seal member 222*b* which seals the discharge port 211. The seal member 222*b* can seal the discharge port 211 to prevent the toner in the toner bottle T1 from leaking through the discharge port 211. The user removes the seal member 222 to open the discharge port 211 of the toner bottle T before the toner bottle T is mounted on the mounting unit 310.

FIG. 4B is a sectional view illustrating essential parts of the toner bottle T when the pump unit 210 of the toner bottle T is fully expanded. FIG. 4C is a sectional view illustrating the essential parts of the toner bottle T when the pump unit 210 of the toner bottle T is fully compressed. The pump unit 210 is an accordion-like pump made of resin. The volumetric capacity of the pump unit 210 changes according to the expansion and compression of the pump unit 210. The "ridge" folds and "valley" folds of the pump unit 210 are alternately arranged in the longitudinal direction of the toner bottle T.

In the present exemplary embodiment, the toner bottle T performs two replenishment operations while making one rotation. One toner replenishment operation starts when the pump unit 210 is fully compressed. The pump unit 210 is then expanded and compressed, and the toner replenishment operation ends when the pump unit 210 is fully compressed.

The cam groove 214 has two peaks and two valley areas, which are formed in the order of a valley, peak, valley, and peak. If the reciprocation member 213 is engaged with the cam groove 214 at the peaks, the pump unit 210 is fully expanded. If the reciprocation member 213 is engaged with the cam groove 214 in the valley areas, the pump unit 210 is fully compressed.

(Configuration of Rotation Detection Sensor)

Next, the rotation detection sensor 203 arranged in the image forming apparatus 200 will be described with reference to FIGS. 5 and 6. The rotation detection sensor 203 is an optical sensor including a light emitting unit and a light receiving unit that receives light emitted from the light emitting unit. If the toner bottle T is mounted on the mounting unit 310, a flag 204 makes contact with the toner bottle T by its own weight at a position overlapping with the areas where the protruded portions 220 are formed in the mounting direction of the toner bottle T. The flag 204 is swingably supported about a rotation shaft 204*a*. When the toner bottle T rotates and the flag 204 is pushed up by a protruded portion 220, the flag 204 swings about the rotation shaft 204*a* and moves to a light blocking position where the flag 204 blocks the optical path of the light emitted from the light emitting unit to the light receiving unit of the rotation detection sensor 203.

FIG. 5 illustrates a state where the flag 204 is in contact with a position overlapping with the areas where the protruded portions 220 are formed in the mounting direction of the toner bottle T and a position falling on an area different from the protruded portions 220 in the rotation direction of the drive transmission unit 206. Since the flag 204 is not in the light blocking position, the light receiving unit can receive the light emitted from the light emitting unit. In such a case, the amount of light received by the light receiving unit is greater than or equal to a threshold.

Figure 6:
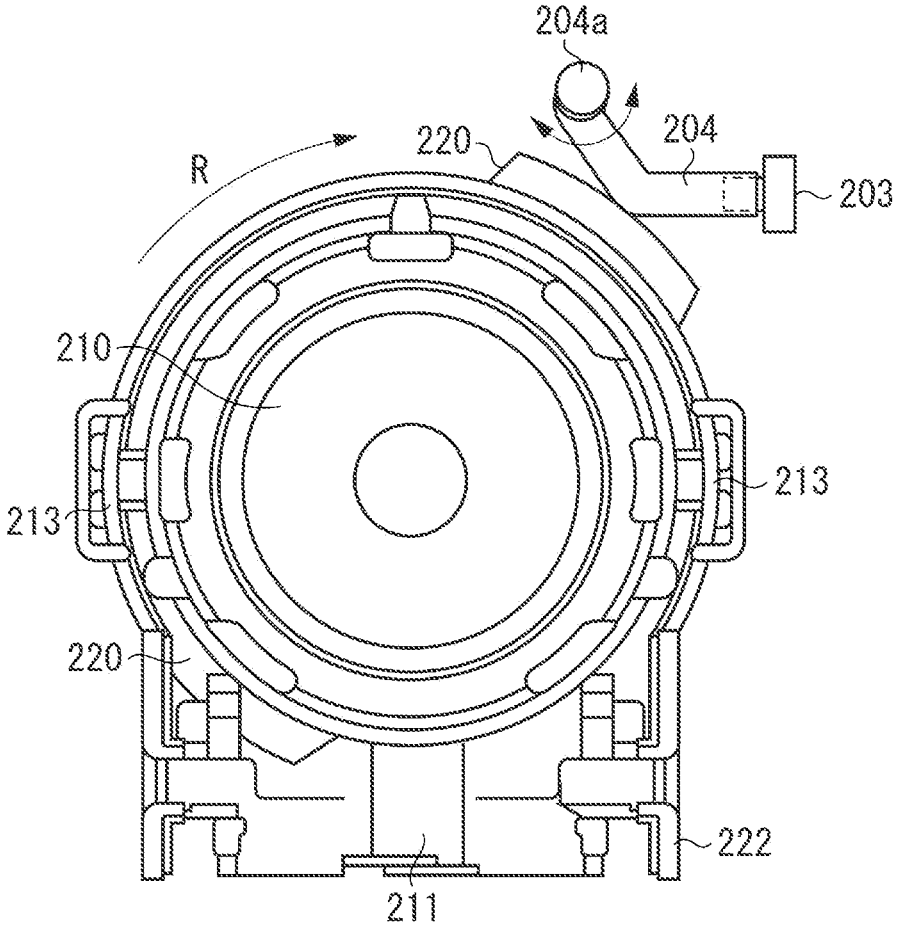
FIG. 6 is a schematic diagram illustrating essential parts of the rotation detection sensor.

FIG. 6 illustrates a state where the flag 204 is in contact with a protruded portion 220. The flag 204 is in the light blocking position, and the light receiving unit cannot receive the light emitted from the light emitting unit. In such a case, the amount of light received by the light receiving unit is smaller than the threshold.

The sensor output detection circuit 607 notifies the ASIC 602 of the result of comparison between the output value of the rotation detection sensor 203 indicating the amount of received light and the threshold value. The sensor output detection circuit 607 (FIG. 2) outputs the high-level signal (logical 'H') if the amount of light received by the light receiving unit is greater than or equal to the threshold. The sensor output detection circuit 607 outputs the low-level signal if the amount of light received by the light receiving unit is smaller than the threshold. That is, the output signal of the sensor output detection circuit 607 changes from a high level to a low level when the flag 204 is pushed up by a first area of the protruded portion 220. The output signal then changes from the low level to the high level when the flag 204 moves along a second area of the protruded portion 220 which is downstream of the first area of the protruded portion 220 in the rotation direction of the toner bottle T.

As illustrated in FIG. 5, while the flag 204 is in contact with an area other than the protruded portions 220, the sensor output detection circuit 607 (FIG. 2) outputs the high-level signal. As illustrated in FIG. 6, while the flag 204 is in contact with a protruded portion 220, the sensor output detection circuit 607 (FIG. 2) outputs the low-level signal. In other words, the sensor output detection circuit 607 and the rotation detection sensor 203 function as a detection unit for detecting the protruded portions 220 of the toner bottle T rotated by the driving motor 604.

In the present exemplary embodiment, the protruded portions 220 are configured to continue pushing up the flag 204 from when the pump unit 210 starts to be compressed to when the pump unit 210 is fully compressed. The sensor output detection circuit 607 (FIG. 2) outputs the low-level signal (logical 'L') during the period from when the pump unit 210 starts to be compressed to when the pump unit 210 is fully compressed. The sensor output detection circuit 607 (FIG. 2) switches from the low-level signal (logical 'L') to the high-level signal (logical 'H') at the time that the pump unit 210 is fully compressed. The sensor output detection unit 607 (FIG. 2) outputs the high-level signal (logical 'H')

while the fully-compressed pump unit 210 is being expanded until the pump unit 210 is fully expanded.

(Rotation Speed Control Processing)

In the present exemplary embodiment, a DC motor (DC brush motor) is used as the driving motor 604. When the driving motor 604 drives the toner bottle T to rotate, the rotation speed of the toner bottle T varies depending on the weight of the toner bottle T. More specifically, as the toner bottle T supplies the toner to the developing unit 100, the amount of toner contained in the toner bottle T decreases and the toner bottle T becomes lighter. If the driving motor 604 continues being controlled without changing the PWM signal, the rotation speed of the toner bottle T increases with the amount of toner contained in the toner bottle T decreasing.

Experiments have shown that the amount of toner replenished from the toner bottle T to the developing unit 100 (the amount of replenishment) has a value corresponding to the speed at which the internal pressure of the toner bottle T changes. If the weight of the toner bottle T decreases and the rotation speed of the toner bottle T becomes higher than a target speed, the amount of replenishment of the toner bottle T becomes greater than the target amount of replenishment.

Figure 7:
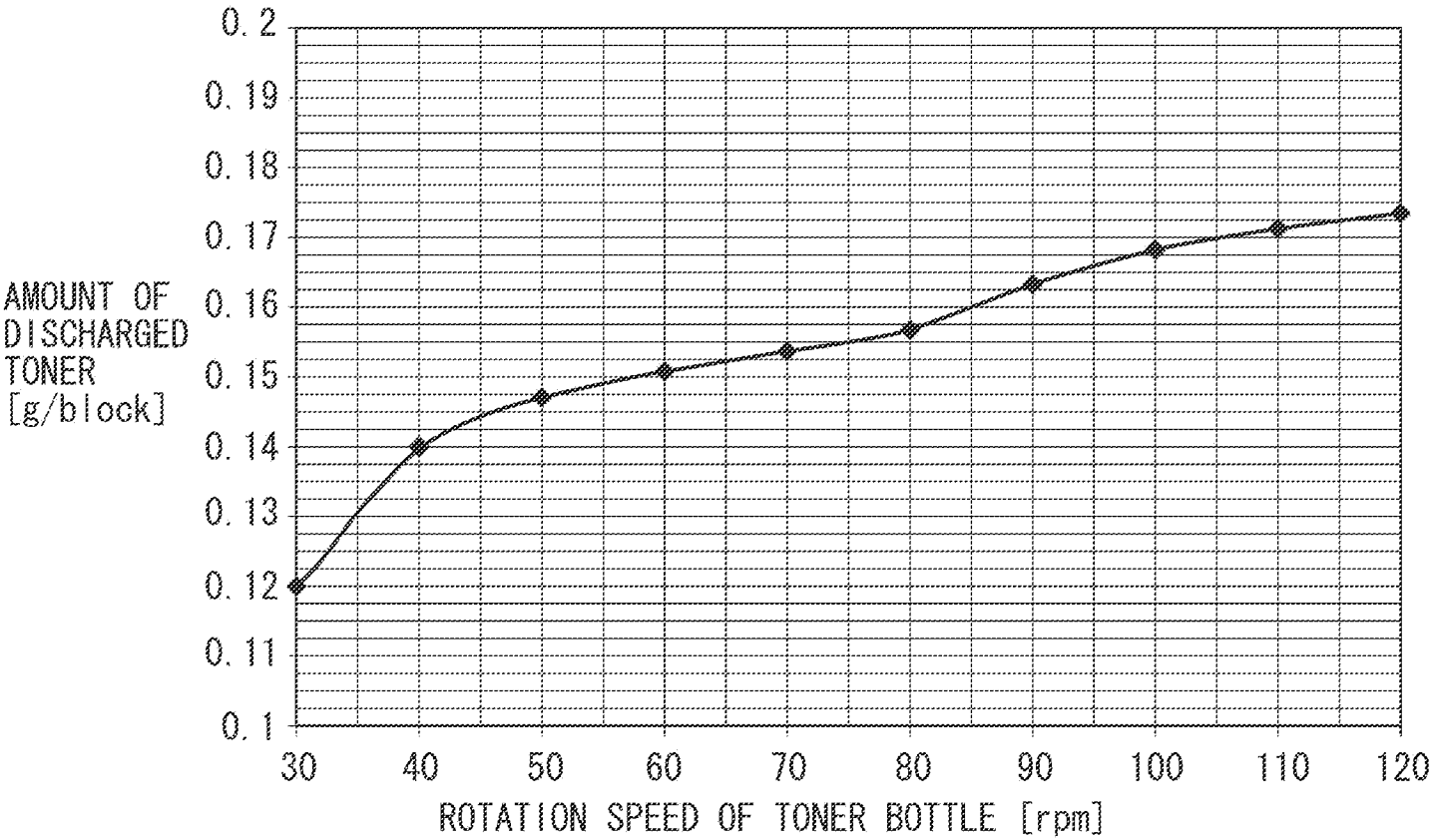
FIG. 7 is a chart illustrating a relationship between a rotation speed of the toner bottle and the amount of discharged toner.

FIG. 7 illustrates a measurement result obtained by experiment regarding the relationship between the rotation speed of the toner bottle T and the amount of toner discharged at a time from the toner bottle T (the amount of discharged toner). As illustrated in FIG. 7, it can be seen that the amount of toner discharged at a time from the toner bottle T increases as the rotation speed of the toner bottle T increases. Specifically, the amount of discharged toner when the rotation speed of the toner bottle T is 120 rpm is 40% greater than the amount of discharged toner when the rotation speed of the toner bottle T is 30 rpm. In the configuration where the developing unit 100 is directly replenished with the toner from the toner bottle T, a variation of 40% in the amount of discharged toner can cause a change in the density of the print product.

In the present exemplary embodiment, the ASIC 602 then measures the time during which a protruded portion 220 of the toner bottle T is detected by the rotation detection sensor 203 while a toner replenishment operation is performed. The ASIC 602 corrects the control value of the PWM signal based on the measurement result. In other words, the PWM signal with which the driving motor 60 drives the toner bottle T to rotate the next time is set based on the rotation speed of the toner bottle T when the driving motor 604 has driven the toner bottle T to rotate based on the current PWM signal. With such a configuration, the PWM signal is corrected based on the actually-measured rotation information about the toner bottle T. This can reduce variations in the rotation speed of the toner bottle T depending on a change in the weight of the toner bottle T.

However, it takes several tens of microseconds for the DC motor (DC brush motor) to rise to a target rotation speed from a start of the rotation drive, and for the DC motor to actually stop after a stop of the power supply to the DC motor.

A toner replenishment operation is thus started with the pump unit 210 fully compressed. The pump unit 210 is then expanded and compressed, and the toner replenishment operation ends with the pump unit 210 fully compressed. According to such a configuration, the DC motor (DC brush motor) is controlled to operate at the rotation speed according to the PWM signal within the period from when the driving motor 604 starts driving to when the pump unit 210 starts being compressed. The amount of discharged toner can thereby be kept constant. In order for the toner bottle T to stop with the pump unit 210 fully compressed, the valley areas of the cam groove 214 have a greater length than that of the peak areas of the cam groove 214. This reduces the possibility that the drive transmission unit 206 rotates to expand the pump unit 210 even after the power supply to the DC motor (DC brush motor) is stopped.

However, the rotation detection sensor 203 may detect a protruded portion 220 even before the rotation speed of the toner bottle T reaches the speed based on the PWM signal after the DC motor (DC brush motor) starts to rotate the toner bottle T. Such a situation can occur when the user mounts the toner bottler T on the mounting unit 310 such that the flag 204 is not in contact with the protruded portions 220 and lies near the front end of the protruded portion 220 in the rotation direction in which the toner bottle T rotates. Since the rotation detection sensor 203 detects the protruded portion 220 even if the DC motor (DC brush motor) has not yet reached the rotation speed according to the currently-set PWM signal, the detection result of the rotation detection sensor 203 has an incorrect value. Therefore, if the PWM signal is corrected based on the time during which the protruded portion 220 is detected by the rotation detection sensor 203, the rotation speed of the toner bottle T driven to rotate based on the corrected PWM signal becomes different from the target rotation speed.

In the present exemplary embodiment, the ASIC 602 is configured not to correct the control value of the PWM signal while the toner replenishment operation is being performed a predetermined number of times after the toner bottle T is mounted on the mounting unit 310. More specifically, in the period from when the toner bottle T is mounted to when the rear ends of the protruded portions 200 in the rotation direction of the toner bottle T are detected a predetermined number of times, the ASIC 602 sets the previous control value of the PWM signal as the control value of the PWM signal. The ASIC 602 will not change the control value of the PWM signal unless the level of the output signal of the sensor output detection circuit 607 has changed a predetermined number of times (predetermined condition).

Figure 8A:
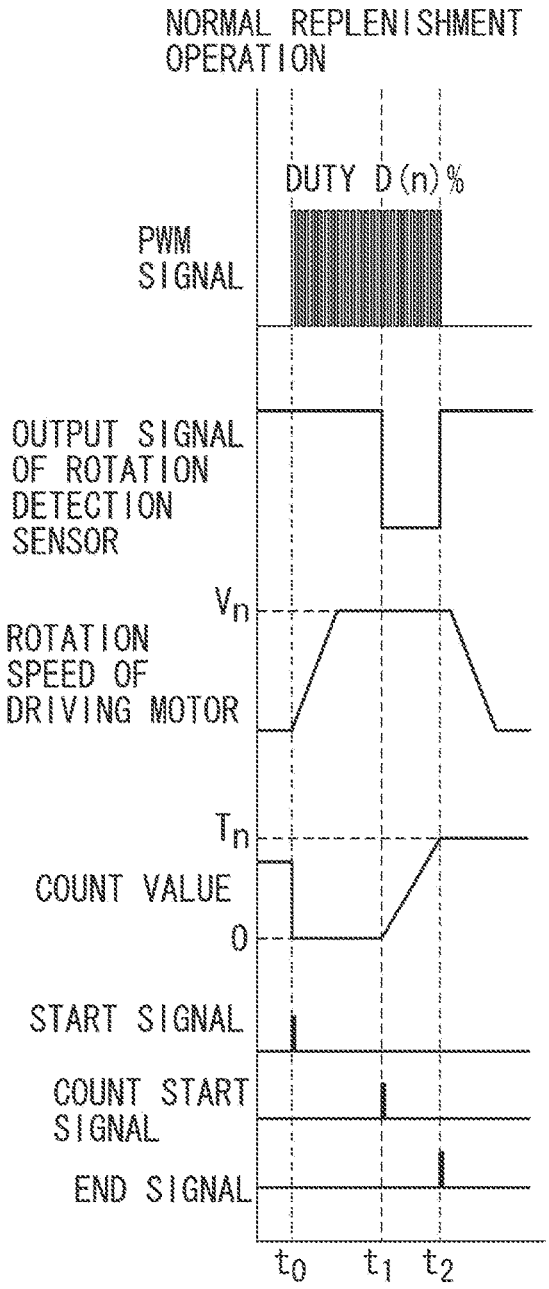
FIGS. 8A and 8B are timing charts.
Figure 8B:
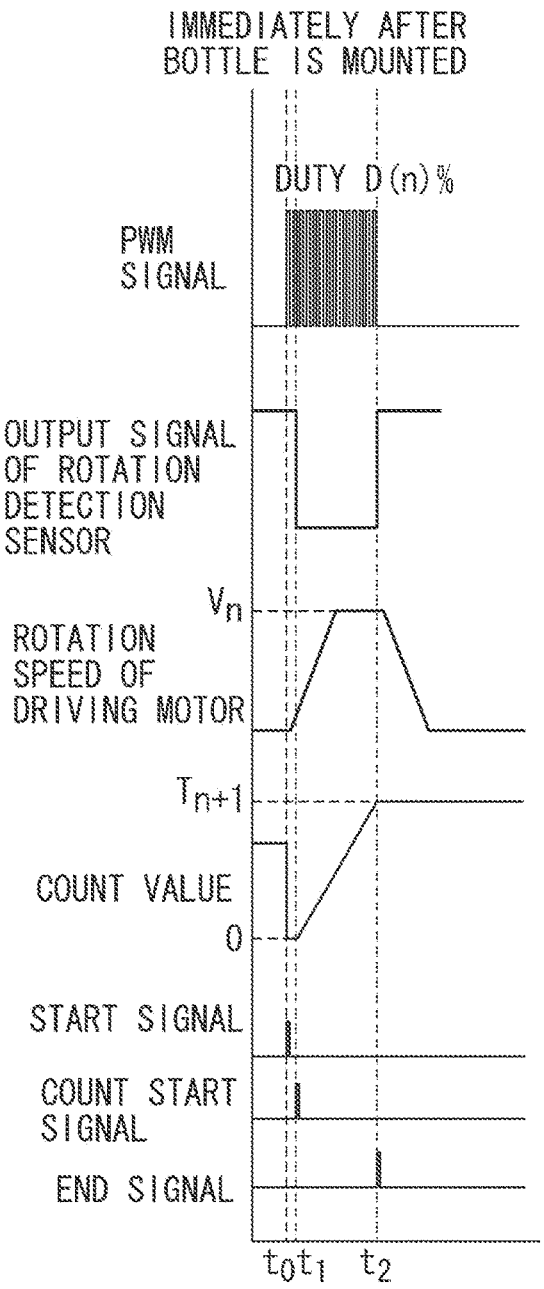

FIGS. 8A and 8B are timing charts illustrating the PWM signal, the output signal of the sensor output detection circuit 607, the rotation speed of the driving motor 604, a count value, a start signal for starting a replenishment operation, a count start signal for starting counting, and a stop signal for ending the replenishment operation. FIG. 8A is a timing chart when the rotation detection sensor 203 detects the protruded portion 220 after the rotation speed of the toner bottle T reaches the rotation speed corresponding to the PWM signal. FIG. 8B is a timing chart when the rotation detection sensor 203 detects the protruded portion 220 before the rotation speed of the toner bottle T reaches the rotation speed according to the PWM signal.

To perform a replenishment operation at time t0, the CPU 601 outputs the start signal to the ASIC 602 at time t0. In response to the input of the start signal to the ASIC 602, the ASIC 602 outputs the PWM signal and the ENB signal to the motor driving circuit 603. The motor driving circuit 603 starts to supply a current to the driving motor 604 according to the PWM signal. The ASIC 602 sets the count value to zero in response to the input of the start signal at time t0.

After the motor driving circuit 603 starts driving the driving motor 604 to rotate, the rotation speed of the driving motor 604 starts to increase. Here, the sensor output detection circuit 607 is outputting the high-level signal. That is, the pump unit 210 of the toner bottle T is not compressed.

At time t1, the rotation detection sensor 203 detects the protruded portion 220. The output signal of the sensor output detection circuit 607 changes accordingly from the high-level signal to the low-level signal. In response to the change of the output signal of the sensor output detection signal 607 from the high-level signal to the low-level signal, the ASIC 602 outputs the count start signal. As a result, the count value Tn starts to increase. Since the sensor output detection circuit 607 is outputting the low-level signal, the pump unit 210 has started to be compressed.

At time t2, the rotation detection sensor 203 detects an area other than the protruded portion 220. The output signal of the sensor output detection circuit 607 changes accordingly from the low-level signal to the high-level signal. In response to the change of the output signal of the sensor output detection circuit 607 from the low-level signal to the high-level signal, the ASIC 602 outputs the stop signal. As a result, the count value Tn stops increasing, and the motor driving circuit 603 stops driving the driving motor 604 to rotate. This indicates that the pump unit 210 of the toner bottle T is fully compressed. The CPU 601 makes the motor driving circuit 603 stop driving the driving motor 604 to rotate such that the toner bottle T stops being driven to rotate before the pump unit 210 is expanded.

In FIG. 8A, the rotation speed of the driving motor 604 has reached the rotation speed Vn corresponding to the PWM signal by the time when the count start signal is output (time t1). In other words, the rotation speed of the toner bottle T is controlled to be a constant speed. Since the length of the protruded portions 220 in the rotation direction of the toner bottle T is determined in advance, the ASIC 602 can calculate the rotation speed of the toner bottle T based on the period (Tn) during which the sensor output detection circuit 607 outputs the low-level signal. In FIG. 8B, the position of the flag 204 is not known immediately after the toner bottle T is mounted on the mounting unit 310. The output signal of the rotation detection sensor 203 changes from the high level to the low level soon after the driving motor 604 is driven.

In FIG. 8B, the rotation speed of the driving motor 604 does not reach the rotation speed Vn corresponding to the PWM signal at the time when the count start signal is output (time t1). In other words, the toner bolt T is still accelerating. The ASIC 602 calculates the rotation speed of the toner bottle T based on the period (Tn+1) during which the sensor output detection circuit 607 outputs the low-level signal. As illustrated in FIG. 8B, the rotation speed calculated based on the period (Tn+1) during which the sensor output detection circuit 607 outputs the low-level signal is lower than the actual rotation speed of the toner bottle T. Suppose that the ASIC 602 determines the control value of the PWM signal based on the time Tn+1 measured while the rotation speed of the toner bottle T is accelerating, and drives the driving motor 604 to rotate based on the determined control value. In such a case, the rotation speed of the toner bottle T becomes higher than the target rotation speed.

Namely, when a toner bottle T is mounted, it is unknown whether the rotation detection sensor 203 detects a protruded portion 220 of the toner bottle T in the state where the driving motor 604 has reached the rotation speed according to the PWM signal. When a toner bottle T is mounted, the ASIC 602 therefore disables the correction of the control value of the PWM signal from when the drive motor 604 starts to rotate the toner bottle T for the first time to when the protruded portions 220 are detected by the rotation detection sensor 203 a predetermined number of times.

Figure 9:
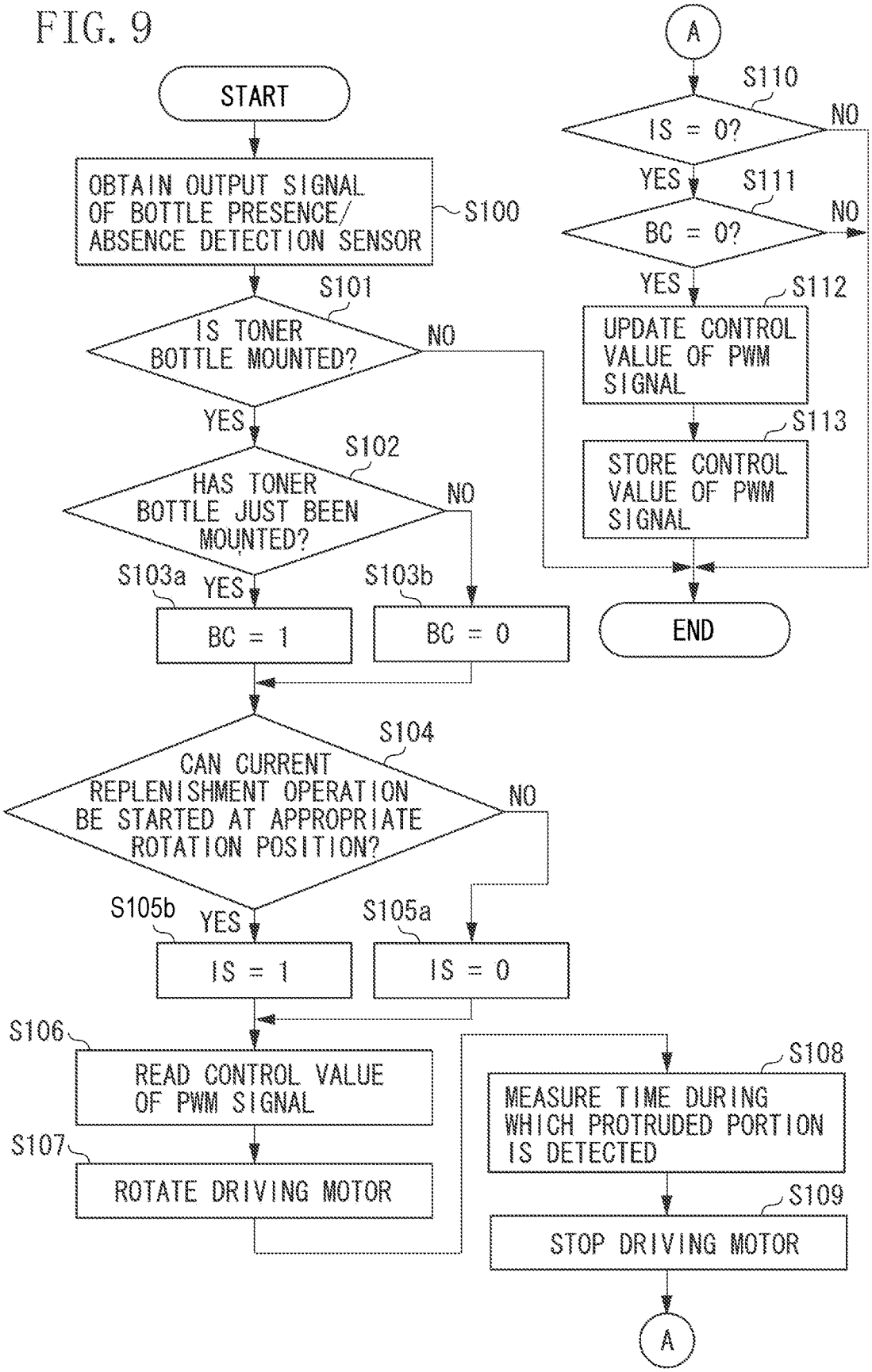
FIG. 9 is a flowchart illustrating a replenishment operation.

A replenishment operation by which the toner bottle T replenishes the developing unit 100 with the toner will be described below with reference to the control block diagram of FIG. 2 and the flowchart of FIG. 9. To execute the replenishment operation illustrated in FIG. 9, the CPU 601 illustrated in FIG. 2 reads a program stored in the ROM 608. The CPU 601 performs the replenishment operation illustrated in FIG. 9 by controlling the ASIC 602. The CPU 601 performs the replenishment operation illustrated in FIG. 9 if the amount of toner in the developing unit 100 detected by the permeability sensor 610 falls to or below a predetermined amount or if the developing unit 100 is predicted to discharge a predetermined amount of toner based on image data.

In step S100, the CPU 601 obtains the output signal of the bottle detection sensor 221. After obtaining the output signal of the bottle detection sensor 221 in step S100, the CPU 601 proceeds to step S101. In step S101, the CPU 601 determines whether a toner bottle T is mounted on the mounting unit 310. In step S101, if the amount of light received by the light receiving unit of the bottle detection sensor 221 is greater than or equal to a threshold, the CPU 601 determines that a toner bottle T is mounted on the mounting unit 310. If the amount of light received by the light receiving unit of the bottle detection sensor 221 is smaller than the threshold, the CPU 601 determines that no toner bottle T is mounted on the mounting unit 310.

In step S101, if no toner bottle T is mounted on the mounting unit 310 (NO in step S101), the CPU 601 ends the replenishment operation. The CPU 601 stores information indicating that a toner bottle T is dismounted from the mounting unit 310 into the EEPROM 606.

In step S101, if a toner bottle T is mounted on the mounting unit 310 (YES in step S101), the CPU 601 proceeds to step S102. In step S102, the CPU 601 determines whether the toner bottle T has just been mounted, based on information stored in the EEPROM 606. Specifically, the CPU 601 determines whether the information indicating that a toner bottle T is dismounted from the mounting unit 310 is stored in the EEPROM 606. If the information indicating that a toner bottle T is dismounted from the mounting unit 310 is stored in the EEPROM 606, it means that the dismounted state has changed to the mounted state. The toner bottle T can thus be determined to have just been mounted. In step S102, if the information indicating that a toner bottle T is dismounted from the mounting unit 310 is not stored in the EEPROM 606 (NO in step S102), the CPU 601 proceeds to step S103*b*. In step S103*b*, the CPU 601 sets a flag BC to 0.

In step S102, if the information indicating that a toner bottle T is dismounted from the mounting unit 310 is stored in the EEPROM 606 (YES in step S102), the CPU 601 proceeds to step S103*a*. In step S103*a*, the CPU 601 sets the flab BC to 1 and clears the information stored in the EEPROM 606. The flag BC having a value of 1 indicates that the toner bottle T has just been mounted on the mounting unit 310 and the toner bottle T has not been rotated yet.

After setting the flag BC in step S103*a* or S103*b*, the CPU 601 proceeds to step S104. In step S104, the CPU 601 determines whether the current replenishment operation can be started at an appropriate rotation position. The appropriate rotation position refers to the rotation position of the toner bottle T stopped with the pump unit 210 fully compressed. More specifically, in step S104, the CPU 601 determines whether the rotation detection sensor 203 is detecting an area other than the protruded portions 220 of the toner bottle T and the sensor output detection circuit 607 is outputting the high-level signal, before the toner bottle T is rotated.

If the signal input from the sensor output detection circuit 607 to the ASIC 602 is at a high level (logical 'H'), the CPU 601 determines that the rotation detection sensor 203 is detecting an area other than the protruded portions 220 of the toner bottle T. In such a case, the CPU 601 determines that the current replenishment operation can be started at an appropriate rotation position (YES in step S104). The CPU 601 proceeds to step S105*a*. In step S105*a*, the CPU 601 sets an error flag IS to 0.

If the signal output from the sensor output detection circuit 607 to the ASIC 602 is at a low level (logical 'L'), the CPU 601 determines that the rotation detection sensor 203 is detecting a protruded portion 220 of the toner bottle T. In such a case, the CPU 601 determines that the current replenishment operation cannot be started at an appropriate rotation position (NO in step S104). The CPU 601 proceeds to step S105*b*. In step S105*b*, the CPU sets the error flag IS to 1.

After setting the error flag IS in step S105*a* or S105*b*, the CPU 601 proceeds to step S106. In step S106, the CPU 601 outputs a signal for starting replenishment to the ASIC 602, and the ASIC 602 in response reads the control value of the PWM signal stored in the RAM 609. The ASIC 602 proceeds to step S107. In step S107, the ASIC 602 sets the control value of the PWM signal stored in the RAM 609 into the motor driving circuit 603, and outputs the ENB signal to the motor driving circuit 603. As a result, the driving motor 604 starts to rotate.

After the driving motor 604 starts driving the toner bottle T to rotate, the ASIC 602 proceeds to step S108. In step S108, the ASIC 602 measures the time during which a protruded portion 220 of the toner bottle T is detected by the rotation detection sensor 203.

Now, a method by which the ASIC 602 measures the time during which the protruded portion 220 of the toner bottle T is detected by the rotation detection sensor 203 in step S108 will be described below. The ASIC 602 waits until the sensor output detection circuit 607 outputs the low-level signal (logical 'L'). In response to the output of the low-level signal from the sensor output detection circuit 607, the ASIC 602 starts counting according to a predetermined clock signal. The ASIC 602 then waits until the sensor output detection circuit 607 outputs the high-level signal (logical 'H'). In response to the change of the signal output from the sensor output detection circuit 607 from the low level to the high level, the ASIC 602 obtains the current count value Tn. The count value Tn corresponds to the time during which the protruded portion 220 of the toner bottle T is detected by the rotation detection sensor 203.

The count value Tn is a measured time from when the front end of the protruded portion 220 in the rotation direction in which the toner bottle T rotates pushes up the flag 204 to when the rear end of the protrude portion 220 in the rotation direction releases the pushing of the flag 204. In other words, the count value Tn is the measured time during which the flag 204 is pushed up by the protruded portion 220.

Return to the description of the replenishment operation. In the present exemplary embodiment, the signal output from the sensor output detection circuit 607 changes from the low level to the high level when the compression processing of the pump unit 210 ends. The ASIC 602 therefore determines that one (one block of) replenishment operation for replenishing the developing unit 110 with the toner from the toner bottle T has been performed. The ASIC 602 then proceeds to step S109. In step S109, the ASIC 602 stops the rotation of the driving motor 604.

In step S109, the ASIC 602 stops the ENB signal which has been input to the motor driving circuit 603. As a result, the driving motor 604 stops rotating. After the ASIC 602 stops driving the driving motor 604 to rotate, the ASIC 602 proceeds to step S110. In step S110, the ASIC 602 determines whether the error flag IS has a value of 0.

If the error flag IS has a value of 0, the current replenishment operation is started at an appropriate rotation position. In other words, the count value Tn measured by the current replenishment operation is reliable. In step S110, if the error flag IS has a value of 0 (YES in step S110), the ASIC 602 proceeds to step S111. In step S111, the ASIC 602 determines whether the flag BC has a value of 0.

If the flag BC has a value of 0, the toner bottle T has not just been mounted on the mounting unit 310. In other words, the toner bottle T has a stable rotation speed according to the PWM signal during the period in which the protruded portion 220 of the toner bottle T is detected by the rotation detection sensor 203. In step S111, if the flag BC has a value of 0 (YES in step S111), the ASIC 602 proceeds to step S112. In step S112, the CPU 601 updates the control value of the PWM signal.

In step S112, the CPU 601 corrects the current control value of the PWM signal stored in the RAM 609, based on the count value Tn measured by the ASIC 602 in step S108. In step S112, the CPU 601 obtains the rotation speed V(n) of the current replenishment operation from the count value Tn. The count value Tn indicates the time during which the flag 204 is in contact with the protruded portion 220. The circumferential length of the protruded portion 220 is known in advance. The CPU 601 can thus determine the rotation speed V(n) of the current replenishment operation based on the count value Tn.

The CPU 601 then corrects the control value of the PWM signal based on the following equation:

$$D(n+1)=D(n)+Ki\times(Vtgt-V(n)),$$

where D(n+1) is the next control value of the PWM signal, D(n) is the current control value of the PWM signal (i.e., the control value of the PWM signal read from the RAM 609 in step S106), Ki is a predetermined constant of proportionality, and Vtgt is the target rotation speed (predetermined speed).

After the control value of the PWM signal is corrected, the CPU 601 proceeds to step S113. In step S113, the CPU 601 stores the control value D(n+1) of the PWM signal calculated in step S112 into the RAM 609. The CPU 601 uses the control value D(n+1) of the PWM signal for the next replenishment operation.

In step S110, if the error flag IS has a value of 1, the current replenishment operation is not started at an appropriate rotation position. The DC brush motor may be still in the process of rising to the target rotation speed when the flag 204 is in contact with the protruded portion 220. In other words, the count value Tn measured by the current replenishment operation is not reliable. In step S110, if the error flag IS has a value of 1 (NO in step S110), the CPU 601 ends the replenishment operation without updating the control value of the PWM signal.

In step S111, if the flag BC has a value of 1, the toner bottle T has just been mounted on the mounting unit 310. The toner bottle T may have yet to reach a stable rotation speed according to the PWM signal during the period in which the protruded portion 220 of the toner bottle T is detected by the control detection sensor 203. In other words, the count value Tn measured by the current replenishment operation is not reliable. In step S111, if the flag BC has a value of 1 (NO in step S111), the CPU 601 ends the replenishment operation without updating the control value of the PWM signal.

As described above, according to the present exemplary embodiment, the ASIC 602 obtains the count value Tn and stops the driving motor 604 in response to the change of the signal output from the sensor output detection circuit 607 from the low level to the high level. In the present exemplary embodiment, the rear ends of the protruded portions 220 in the rotation direction in which the toner bottle T rotates are designed to correspond to the end timing of the compression of the pump unit 210. The detection result of the rear ends of the protruded portions 220 is used as an index indicating both the end of the measurement time of the rotation speed and the end of the replenishment operation. This can simplify the configuration of the protruded portions 220 arranged on the drive transmission unit 206 and simplify the control of the CPU 601 as well.

According to the present exemplary embodiment, if there is the possibility that the rotation speed of the toner bottle T cannot be accurately measured immediately after the toner bottle T is mounted, the feedback control based on the measurement result of the rotation speed of the toner bottle T is not performed. As a result, the rotation speed of the toner bottle T can be quickly controlled to be the target rotation speed.

More specifically, if the toner bottle T is rotated for the first time after the toner bottle T is mounted, the feedback control of the driving motor 604 based on the detection result of the rotation detection sensor 203 is not performed. Such a configuration can reduce the number of times to rotate the toner bottle T before the rotation speed of the toner bottle T is controlled to be the target rotation speed. Accordingly, the amount of toner discharged from the toner bottle T can thus be quickly stabilized.

Depending on the positional relationship between the protruded portions 220 and the flag 204 of the rotation detection sensor 203 when the toner bottle T is mounted, the rotation detection sensor 203 can detect a protruded portion 220 while the toner bottle T is accelerating. In such a case, if the control value of the PWM signal is corrected based on the time during which the protruded portion 220 is detected by the rotation detection sensor 203, the rotation speed of the toner bottle T may not be controlled to be the target speed. The reason is that the protruded portion 220 is detected by the rotation detection sensor 203 before the rotation speed of the DC motor (DC brush motor) having started to rotate the toner bottle T reaches the rotation speed according to the currently-set PWM signal. Since the time during which the protruded portion 220 is detected by the rotation detection sensor 203 cannot be accurately measured, the rotation speed of the toner bottle T that is driven to rotate by using the PWM signal corrected based on the measurement time will not coincide with the target speed.

According to the present exemplary embodiment, the CPU 601 is configured not to perform the feedback control based on the rotation speed of the toner bottle T after a toner bottle T is detected by the bottle detection sensor 221 and when there is stored the information indicating that a previous toner bottle is dismounted from the mounting unit 310. However, the CPU 601 may be configured to, if a toner bottle T is detected to be mounted on the mounting unit 310, detect an identification tag attached to the toner bottle T and determine whether the toner bottle T is the same as the one before the dismounting, based on the detected tag information. Such a configuration can be implemented by providing the mounting unit 310 with an acquisition unit (reading unit) for obtaining the tag information. The CPU 601 may be configured to, if the current toner bottle T mounted on the mounting unit 310 is different from the toner bottle T dismounted from the mounting unit 310 the last time, not perform the feedback control based on the rotation speed of the toner bottle T rotated immediately after the mounting of the toner bottle T. Suppose that the user dismounts the toner bottle T at arbitrary timing and mounts the toner bottle T again. In such a case, even in the first rotation, the toner bottle T can be rotated at the same rotation speed as before the toner bottle T is dismounted.

Alternatively, the CPU 601 may be configured to, if a toner bottle T is detected to be mounted on the mounting unit 310, not perform the feedback control based on the rotation speed of the toner bottle T until the number of rotations of the toner bottle T from the start of rotation of the toner bottle T exceeds a predetermined number of times. The CPU 601 may be further configured to, if a toner bottle T is detected to be mounted on the mounting unit 310, not perform the feedback control based on the rotation speed of the toner bottle T until the CPU 601 outputs the signals for starting the replenishment operation from the toner bottle T, to the developing unit 110 a predetermined number of times.

In such a configuration, the control value of the PWM signal input to the driving motor 604 in response to the output of the signal for starting the replenishment operation by the CPU 601 may be set to the same control value until the replenishment operation is performed a predetermined number of times. The CPU 601 may be further configured to, if a toner bottle T is detected to be mounted on the mounting unit 310, not perform the feedback control based on the rotation speed of the toner bottle T until a number of rotations of the toner bottle T exceeds a predetermined number since the start of the rotation of the toner bottle T.

According to the present exemplary embodiment, the toner bottle T includes two protruded portions 220 on the periphery of the drive transmission portion 206 so that the toner bottle T performs two replenishment operations while making one rotation. However, the toner bottle T may be configured to perform one replenishment operation while making one rotation. In such a case, the toner bottle T is configured to include only one protruded portion 220 on the drive transmission unit 206. The toner bottle T performs the replenishment operation to replenish the developing unit 100 with toner while the sensor output detection circuit 607 is outputting the low-level signal in response to the detection of the protruded portion 220 by the rotation detection sensor 203.

The toner bottle T may be configured to perform three or more replenishment operations while making one rotation. In such a configuration, the toner bottle T includes three or more protruded portions 220 on the drive transmission unit 206. The toner bottle T performs the replenishment operation to replenish the developing unit 100 with toner while the sensor output detection circuit 607 is outputting the low-level signal in response to the detection of each protruded portion 220 by the rotation detection sensor 203.

The present exemplary embodiment is not limited to the configuration where the output signal of the sensor output detection circuit 607 changes from the high level to the low level at the timing that the toner bottle T starts to be compressed. The output signal of the sensor output detection circuit 607 may be configured to change from the high level to the low level when a predetermined time has elapsed after the toner bottle T starts to be compressed. Similarly, the present exemplary embodiment is not limited to the configuration where the output signal of the sensor output detection signal 607 changes from the low level to the high level after the toner bottle T is fully compressed. The output signal of the sensor output detection circuit 607 may be configured to change from the low level to the high level before the toner bottle T is fully compressed.

In the present exemplary embodiment, the sensor output detection output circuit 607 is configured to output the low-level signal while the toner bottle T is performing a replenishment operation, and output the high-level signal while the toner bottle T is performing no replenishment operation. However, the sensor output detection circuit 607 may output the output signals in a reverse relationship. More specifically, the sensor output detection circuit 607 may be configured to output the high-level signal when the toner bottle T is performing a replenishment operation, and output the low-level signal when the toner bottle T is performing no replenishment operation.

In the present exemplary embodiment, the sensor output detection circuit 607 is configured to continue outputting the low-level signal while the toner bottle T is performing a replenishment operation. However, the sensor output detection circuit 607 may be configured to output a signal (first signal) which indicates that the pump unit 210 has started compression, and a signal (second signal) which indicates that the pump unit 210 has completed full compression. The CPU 601 may be configured to correct the PWM setting value for performing rotary drive of the toner bottle T, based on the time from when the sensor output detection circuit 607 outputs the first signal to when the sensor output detection circuit 607 outputs the second signal.

The present exemplary embodiment is configured such that a replenishment operation is performed if the amount of toner in the developing unit 100 falls below a predetermined amount. However, a replenishment operation may be performed if the ratio of the toner in the developing unit 100 falls below a predetermined ratio. For example, if the developing unit 100 is configured to develop an electrostatic latent image using a two-component developer including toner and a carrier, the CPU 601 may compare the ratio between the amount of the toner and that of the developer, with a predetermined ratio.

According to an exemplary embodiment of the present invention, the rotation speed of the container can be accurately controlled.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a photosensitive member;

an exposure unit configured to expose the photosensitive member to form an electrostatic latent image on the photosensitive member;

a developing unit configured to develop the electrostatic latent image with toner;

a mounting unit to which a container is mountable, the container containing toner;

a detection unit configured to detect that the container is mounted on the mounting unit;

a determination unit configured to determine whether the container is exchanged with another container based on the detection result by the detection unit;

a driving unit configured to rotate the container mounted on the mounting unit to replenish the developing unit with the toner from the container;

a rotation detection unit configured to detect rotation information associated with the container rotated by the driving unit; and a controller configured to execute a feedback control based on the rotation information detected by the rotation detection unit to control the driving unit, wherein the controller, after the determination unit determines that the container is exchanged with the another container, executes another control different from the feedback control to control the driving unit until a predetermined condition is satisfied.

2. The image forming apparatus according to claim 1, wherein the rotation detection unit includes a sensor configured to detect a predetermined portion of the container rotated by the driving unit, and the sensor outputs a first signal during a first period that the predetermined portion of the container is detected, and outputs a second signal during a second period that the predetermined portion of the container is not detected, and the rotation detection unit detects the rotation information based on the output result of the sensor.

3. The image forming apparatus according to claim 1, wherein the container includes a case in which toner is stored and a pump unit configured to change an internal pressure of the case, wherein the pump unit is expanded and compressed according to rotation of the container to supply the toner from the case to the developing unit.

4. The image forming apparatus according to claim 1, wherein the controller controls the driving unit such that a rotation speed of the container becomes a predetermined speed, based on a first time point at which a first area of the container is detected by the rotation detection unit and a second time point at which a second area downstream of the first area in a rotation direction of the container is detected by the rotation detection unit.

5. The image forming apparatus according to claim 4, wherein the controller is configured to control the driving unit such that the rotation speed of the container becomes the predetermined speed, based on time between the first time point and the second time point.

6. The image forming apparatus according to claim 1, wherein the driving unit is a DC motor, and wherein the controller controls a current to be supplied to the DC motor.

7. The image forming apparatus according to claim 1, wherein the predetermined condition is satisfied in a case where a number of rotations of the another container exceeds a predetermined number since the start of the rotation of the another container.

8. The image forming apparatus according to claim 1, wherein the predetermined condition is satisfied in case where the number of executions of a replenishment operation by the driving unit reaches a predetermined number of executions.

9. The image forming apparatus according to claim 8, wherein the predetermined number of executions is 1.

* * * * *